United States Patent [19]

Rintala et al.

[11] Patent Number: 4,955,484

[45] Date of Patent: Sep. 11, 1990

[54] DEVICE FOR SEPARATING HARD OBJECTS, SUCH AS STONES, FROM A STREAM OF WOOD

[75] Inventors: Kari Rintala, Helsinki; Jyrki Paarma, Soramaki; Mikko Sissala, Hyvinkaa, all of Finland

[73] Assignee: Kone Oy, Finland

[21] Appl. No.: 314,541

[22] Filed: Feb. 23, 1989

[30] Foreign Application Priority Data

Feb. 29, 1988 [FI] Finland ..... 880930

[51] Int. Cl.[5] ..... B07C 5/34

[52] U.S. Cl. ..... 209/599; 73/587; 209/518; 209/590

[58] Field of Search ..... 209/517, 518, 520, 590, 209/599, 698, 941; 73/579, 587 X; 340/674; 193/35 R

[56] References Cited

U.S. PATENT DOCUMENTS

| | | | |
|---|---|---|---|
| 2,208,202 | 7/1940 | Stanton et al. | 209/590 |
| 2,593,089 | 4/1952 | Barry | 173/35 R |
| 3,394,806 | 7/1968 | Vaillette | 209/590 |
| 3,559,805 | 2/1971 | Cragg | 209/599 X |
| 4,147,620 | 4/1979 | Artiano et al. | 209/590 |
| 4,309,903 | 1/1982 | Ono | 73/587 |
| 4,602,716 | 7/1986 | Barla-Szabo et al. | 209/599 |

FOREIGN PATENT DOCUMENTS

| | | | |
|---|---|---|---|
| 285255 | 9/1966 | Australia | 209/599 |
| 1145702 | 3/1969 | United Kingdom | 209/599 |

*Primary Examiner*—Donald T. Hajec

*Attorney, Agent, or Firm*—Lerner, David, Lettenberg, Krumholz & Mentlik

[57] ABSTRACT

A device is disclosed for separating hard objects, such as stones, from a stream of wood in an apparatus for conveying or manipulating logs or blocks of wood including a conveyor section. The device includes a transducer disposed in a location suited for the detection of vibration. The transducer registers acoustic vibrations and is connected to a control unit by means of which hard objects conveyed along with the wood stream can be detected on the basis of the vibration signals they generate. The control unit is also used to control an exit gear incorporated in the conveyor section, so that hard objects which are detected will fall down from the stream of wood passing through the apparatus. The invention eliminates the need to build water-operated stone catchers as conventionally used for the removal of stones.

13 Claims, 3 Drawing Sheets

DEVICE FOR SEPARATING HARD OBJECTS, SUCH AS STONES, FROM A STREAM OF WOOD

FIELD OF THE INVENTION

This invention relates to a device for separating hard objects, such as stones, from a stream of wood in an apparatus conveying or manipulating logs or blocks of wood.

DESCRIPTION OF THE PRIOR ART

In wood processing plants, such as saw mills and pulp mills, conveyors are generally used for the transportation of logs and blocks of wood. When stones, metal objects or other hard objects carried along with the wood stream on the conveyors get into a processing machine, e.g. a chipper, this often leads to a shutdown in production and necessitates repairs. Therefore, it is important that hard objects be removed from the stream of wood prior to further processing thereof.

Furruginous objects carried with the wood can be detected, e.g. by means of metal detectors. In order to remove stones from a stream of wood, a common method has been to use a stone catcher built in connection with the conveyor. The stone catcher is a basin filled with water, over which the wood stream is passed, so that the stones, having a higher specific gravity, sink to the bottom of the basin.

In order to prevent the wet wood from sinking with the stones, additional water is supplied from the bottom of the basin to produce an upward flow. The water exits the basin at its top edges as an overflow and is collected and recirculated. Before recirculation, the water must be purified to remove the bark and other refuse carried into the basin with the wood. However, the heavy logs and blocks of wood cannot always be prevented from sinking, and an additional drawback is the complex water supply and purification system which is otherwise unnecessary in a modern wood processing plant employing a dry debarking method.

So far, no solution has been proposed for the separation of stones without the use of water in an apparatus manipulating logs and blocks of wood.

Solutions have been proposed in other fields for the detection of materials other than wood. For example, German patent application DE No. 2946797A1 proposes an apparatus which classifies small objects on the basis of the sound they produce and places them in different containers. The small objects fall along a groove-like track onto a plate and the sound thus produced is compared to that caused by a small reference object. This sound is utilized by a comparator unit which controls a small actuator which guides the falling small object into a given container. However, this prior system cannot be used for the separation of stones from a stream of logs and blocks of wood.

SUMMARY OF THE INVENTION

An object of the present invention is to provide a device which enables the separation of stones from a stream of wood on a conveyor without the use of a water-operated stone catcher. The device of the invention mainly consists of the conveyor, which is required in any case, to which has been added only the equipment needed for the detection and removal of stones.

Accordingly, the invention provides a device for separating hard objects from a stream of wood in an apparatus for conveying or manipulating logs or blocks of wood, which comprises: a conveyor section, at least one transducer capable of registering acoustic vibrations, a control unit connected to said at least one transducer by means of which hard objects conveyed along with the wood stream can be detected on the basis of the vibration signals they generate, and an exit gear incorporated in the apparatus for conveying or manipulating tree trunks and controlled by said control unit, so that said hard objects can fall down from the steam of wood passing through the apparatus.

BRIEF DESCRIPTION OF THE DRAWINGS

Further objects, features and advantages of the invention will become apparent to those skilled in the art from the following description thereof when taken in conjunction with the accompanying drawings, in which.

DESCRIPTION OF THE PREFERRED EMBODIMENTS

Figure 1:
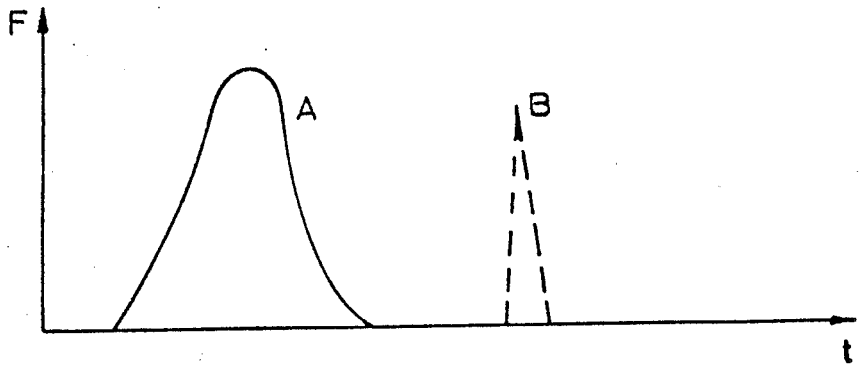
FIG. 1 shows graphically the forms of force impulses generated when a hard object hits a soft object (A) and when a hard object hits another hard object (B)
Figure 2:
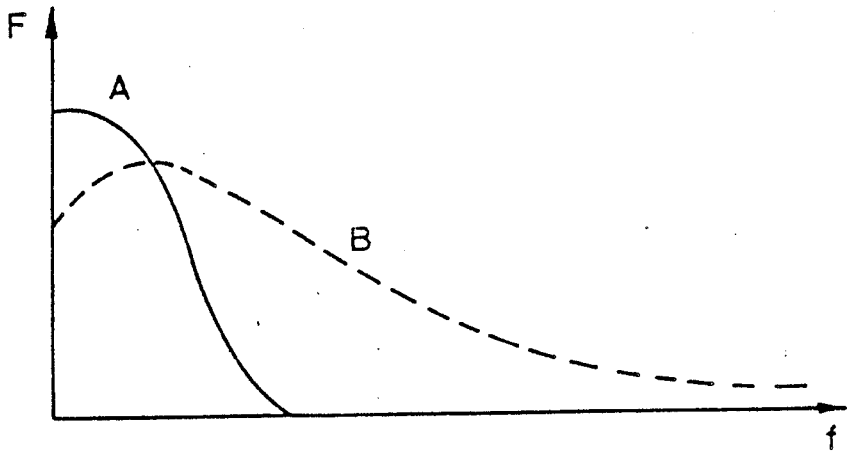
FIG. 2 shows graphically the frequency distribution (power spectral density) of force impulses as shown in FIG. 1, curve A representing a collision of a hard object and a soft object, and curve B representing a collision of two hard objects.
Figure 3:
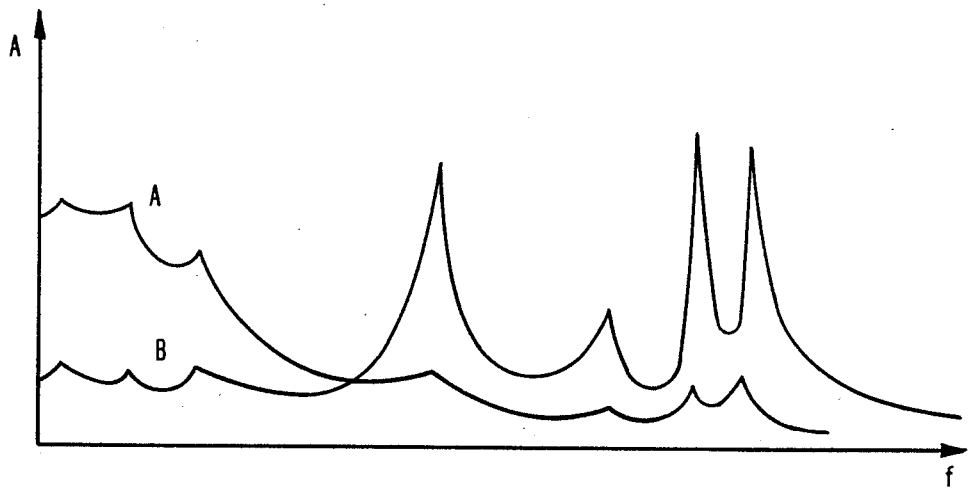
FIG. 3 depicts graphically the amplitude/frequency distribution of the vibration generated in a steel structure in an apparatus when hit by a wooden object A and, correspondingly, when hit by a hard object B.

When a wooden object collides with a metal structure, the force impulse generated is of a "soft" form and has a relatively long duration, as indicated by curve A in FIG. 1. In the frequency distribution of such an impulse (curve A in FIG. 2), the lower frequencies of vibration have larger amplitude values than the higher frequencies, as indicated by curve A in FIG. 3. The vibration frequencies generated by impacts from wooden objects are typical natural frequencies of large structural assemblies.

When a hard object such as a stone collides with a metal structure, the resulting force impulse is of a "sharp" form and is relatively short in duration, as indicated by curve B in FIG. 1. The range of vibration frequencies in the collision impulse is extended to higher frequencies, as shown by curve B in FIG. 2. As illustrated by curve B in FIG. 3, the amplitude distribution contains more high frequencies than in the case of a collision of wood and metal. These vibration frequencies produced in the metal structure by the impacts of hard objects are typically high local resonant frequencies of the surface of the structure.

Figure 4:
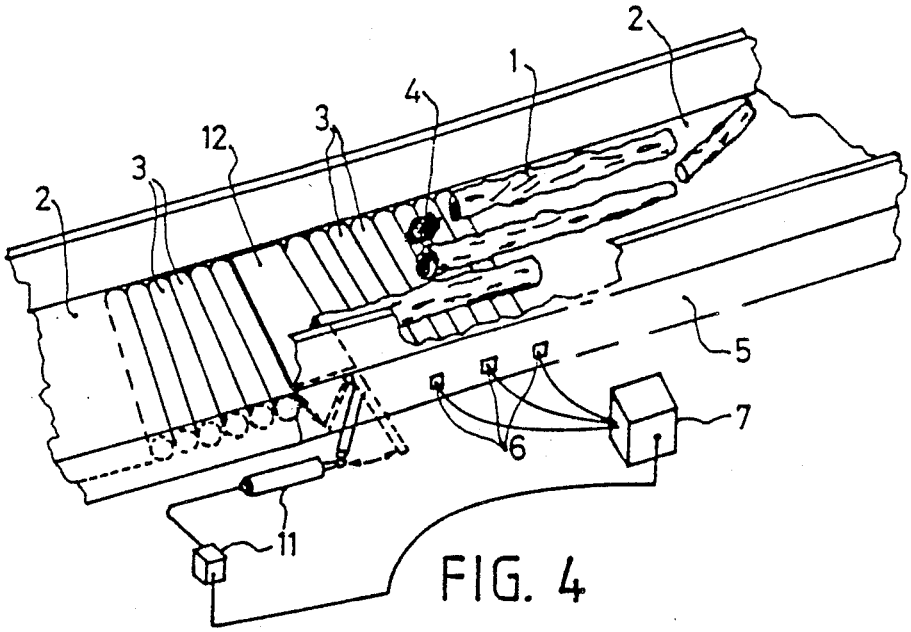
FIG. 4 is a diagrammatic perspective view of an embodiment of the device of the invention.

As an example of an embodiment of the invention, FIG. 4 shows part of a log conveyor on which a stone or other hard object 4 is carried along with logs and blocks of wood 1. As the stone 4 reaches steel conveyor rollers 3 in conveyor section 2, the impacts resulting from the stone hitting the rollers cause vibrations and sounds. These vibrations are identified by vibration transducers 6 attached to steel structure 5 of the apparatus and the vibration signals are processed by a measurement and control unit 7. When the hard object 4 thus detected reaches the location of an exit gear included in the device, the control unit 7 sends a command to an actuator 11 of an exit door 12, which is disposed between the rollers 3 at a point further downstream on the conveyor. After and adjustable delay depending on the speed of the conveyor, the actuator 11 opens the exit door 12, so that the stone 4 will fall down into a space below the conveyor.

The measuring point of one or more of the vibration transducer 6 used with the device of the invention may also be a bearing, the housing of a bearing, a supporting structure, a conveyor wall, or a plate, roller, bar, disc or similar metal object specifically designed for this purpose and preferably insulated against vibratory influences from the environment.

The vibration transducer 6 used in the device of the invention may also consist of a microphone, or the device may be provided with both a microphone and a vibration transducer 6. Via the medium of air, the microphone measures the sound generated by the mechanical vibration of the conveyor.

The device of the invention may be covered with sound insulation to reduce environmental background noise when a microphone is used for the detection of vibration.

Figure 5:
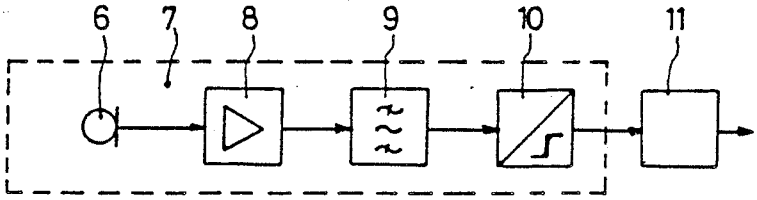
FIG. 5 is a block diagram showing schematically an embodiment of a signal processing unit.

FIG. 5 shows a block diagram of the signal processing unit used in an embodiment of the device of the invention. In addition to the vibration transducers 6, the measurement and control unit 7 comprises an amplifier 8, a filter 9 and a unit 10 for measurement of the r.m.s. value. The signal provided by the transducer 6 is amplified by the adjustable amplifier 8, whose output signal is filtered by a bandpass filter 9 to achieve a better signal-to-noise ratio. The filter 9 is so tuned that only vibrations caused by the impacts of hard objects are passed through, while vibrations caused by the impacts of wooden objects are not passed through at all or are considerably attenuated when they reach the next stage 10, where the r.m.s. value of the amplitude of the vibration signal is measured. The unit 10 measuring the r.m.s. value measures the signal strength in terms of an average value suitably obtained or a quantity proportional thereto, e.g. the r.m.s. value. When the signal strength exceeds a certain preset limit, the unit 10 measuring the r.m.s. value sends a control signal to the actuator 11, which then opens the exit door 12 to remove the stone 4.

It will be obvious to a person skilled in the art that the invention is not restricted to the embodiments described above, but that the invention may instead be varied within the scope of the appended claims.

We claim:

1. A device for separating hard objects from a continuous stream of logs and/or blocks of wood in an apparatus for the continuous conveyance of logs and/or blocks of wood, which device comprises:

a. metal conveyor section comprised of metal rollers for conveying said wood stream and a metal support structure for said metal rollers;

b. at least one vibration sensitive transducer in conductive contact with the metal conveyor section for registering vibrations;

c. means operatively connected to said at least one vibration sensitive trasnducer for distinguishing between signals generated by at least one said transducer in response to impact of logs and/or blocks of wood and signals generated on impact of hard objects on said conveyor section, including means for distinguishing between the frequencies of vibration caused respectively by logs and/or blocks of wood and by hard objects, d. a control unit which incorporates said distinguishing means, for generating a control signal by which hard objects conveyed along with the wood stream can be detected on the basis of the vibration signals as they generate; and e. actuator means which upon receipt of a control signal from said control unit, activates an exit gear, said exit gear being controlled by said control unit through said actuator means, so that said hard objects fall out from a wood stream passing through the apparatus.

2. A device for the separation of hard materials from a continuous stream of logs and/or blocks of wood in accordance with claim 1, wherein said conveyor section includes a succession of conveyor rollers immediately preceding said exit gear, and said exit gear includes an exit door which is opened and closed by said actuator means, said exit gear being located transversely relative to the direction of flow of the wood stream.

3. A device for the separation of hard materials from a continuous stream of logs and/or blocks of wood in accordance with claim 1, wherein said control unit comprises an adjustable amplifier for amplifying the signal obtained from said at least one vibration transducer, distinguishing means consisting of a high frequency bandpass filter for filtering the amplified signal, and a unit for measuring the r.m.s. value of the amplified and filtered vibration signal.

4. A device for the separation of hard materials from a continuous stream of logs and/or blocks of wood in accordance with claim 3, wherein said unit measuring the signal r.m.s. value issues a control signal to the actuator means when the r.m.s. value of the vibration signal exceeds a certain preset limit.

5. A device for the separation of hard materials from a continuous stream of logs and/or blocks of wood in accordance with claim 4, wherein said unit delays the control signal to said actuator means by a predetermined amount of time.

6. A device for the separation of hard materials from a continuous stream of logs and/or blocks of wood in accordance with claim 1, wherein said at least one transducer is mounted on the metal support structure of the metal conveyor system.

7. A device for the separation of hard materials from a continuous stream of logs and/or blocks of wood in accordance with claim 6, wherein said metal support structure comprises a roller bearing, the housing of a roller bearing, or a wall of said conveyor section.

8. A device for the separation of hard materials from a continuous stream of logs and/or blocks of wood in accordance with claim 6, wherein said metal support structure is elastically insulted against vibration from the continuous conveyance device, and from background environment.

9. A device for the separation of hard materials from a continuous stream of logs and/or blocks of wood in accordance with claim 1, wherein said rollers, bearings for said rollers and a bearing housing are elastically insulted from said metal support structure.

10. A device for the separation of hard materials from a continuous stream of logs and/or blocks of wood in accordance with claim 1, wherein said conveyor section is elastically insulted from vibration from the remainder of the continuous conveyance apparatus and from the background environment.

11. A device for the separation of hard materials from a continuous stream of logs and/or blocks of wood in accordance with claim 1, wherein said at least one transducer is a microphone which measures acoustic vibrations of said rollers in response to impact by hard objects.

12. A device for the separation of hard materials from a continuous stream of logs and/or blocks of wood in accordance with claim 1, wherein said conveyor section is wholly covered with a sound insulating covering.

13. A device for the separation of hard materials from a continuous stream of logs and/or blocks of wood in accordance with claim 1, wherein said conveyor section is partially covered with a sound insulating covering.

* * * * *